US007595707B2

(12) United States Patent
Kubo

(10) Patent No.: US 7,595,707 B2
(45) Date of Patent: Sep. 29, 2009

(54) MICROSTRIPLINE TYPE DIRECTIONAL COUPLER AND COMMUNICATION DEVICE USING THE SAME

(75) Inventor: Hiroyuki Kubo, Kusatsu (JP)

(73) Assignee: Murata Manufacturing Co., Ltd. (JP)

( * ) Notice: Subject to any disclaimer, the term of this patent is extended or adjusted under 35 U.S.C. 154(b) by 189 days.

(21) Appl. No.: 10/579,819

(22) PCT Filed: May 17, 2005

(86) PCT No.: PCT/JP2005/008927

§ 371 (c)(1),
(2), (4) Date: May 17, 2006

(87) PCT Pub. No.: WO2005/114777

PCT Pub. Date: Dec. 1, 2005

(65) Prior Publication Data

US 2008/0204162 A1 Aug. 28, 2008

(30) Foreign Application Priority Data

May 21, 2004 (JP) ..... 2004-152082

(51) Int. Cl.
*H01P 5/18* (2006.01)
*H01P 3/08* (2006.01)

(52) U.S. Cl. ..... 333/116; 333/109

(58) Field of Classification Search ..... 333/109, 333/110, 111, 112, 116
See application file for complete search history.

(56) References Cited

U.S. PATENT DOCUMENTS 6,781,476 B2 * 8/2004 Tsunoda et al. ..... 333/110

FOREIGN PATENT DOCUMENTS

| | | |
|---|---|---|
| JP | 54-023447 A | 2/1979 |
| JP | 2-26103 | 1/1990 |
| JP | 7-283621 A | 10/1995 |
| JP | 10-79608 | 3/1998 |
| JP | 10-178307 | 6/1998 |
| JP | 2003-32013 | 1/2003 |
| JP | 2003-198222 | 7/2003 |

OTHER PUBLICATIONS

International Search Report PCT/JP2005/008927, Aug. 15, 2005.
Written Opinion PCT/JP2005/008927. Jul. 28, 2005.
Japanese Office Action for corresponding application No. JP 2006-513690, dated Sep. 5, 2007.
International Search Report PCT/JP2005/008927, Aug. 15, 2005.
Written Opinion PCT/JP2005/008927. Jul. 28, 2005.

* cited by examiner

*Primary Examiner*—Dean O Takaoka
(74) *Attorney, Agent, or Firm*—Dickstein, Shapiro, LLP.

(57) ABSTRACT

A directional coupler having a grounding electrode on one surface of a substrate, a coupling line portion on a second surface of the substrate, and a main line disposed so as to be coupled at high frequencies to the coupling line portion. The grounding electrode includes a notch portion opposite to the coupling line portion.

10 Claims, 5 Drawing Sheets

MICROSTRIPLINE TYPE DIRECTIONAL COUPLER AND COMMUNICATION DEVICE USING THE SAME

FIELD OF THE INVENTION

The present invention relates to a directional coupler used in the microwave band and the millimeter wave band and a communication device using the directional coupler.

BACKGROUND OF THE INVENTION

In the base station of portable telephones, etc., using the quasi-microwave band or the microwave band, a directional coupler is used in order to monitor the transmission power at the base station. A high-frequency front end portion in the base station of portable telephones, etc., is composed of a transmission or reception filter using a dielectric resonator, a low-noise amplifier, etc., and connected to a transmission and reception antenna. The high-frequency front end portion monitors whether the base station transmits an electric power necessary for making the communication in a fixed area possible and the circuit is constructed so as to be able to stably transmit an electric power on the basis of the monitoring result. The directional coupler is used for monitoring the electric power transmission and disposed between the transmission and reception antenna and the high-frequency front end portion. Furthermore, as a coupling line for making the directional coupler coupled to a main line inside the circuit, a microstrip line characterized in that the production is easy and that the coupling to lines in various shapes can be easily obtained is often used.

In Patent Document 1, in a circuit using a waveguide as a main line, a directional coupler in which a microstrip line is inserted into the waveguide is shown. When a microstrip-line type coupling line is inserted into a waveguide, the electromagnetic field inside the waveguide is coupled to the microstrip line at high frequencies and a part of the electric power inside the waveguide can be taken out.

However, when a microstrip line is inserted in a waveguide, there was a problem in that it becomes difficult to specify the directivity to the waveguide because of the influence of the grounding electrode on the back surface of the substrate. Then, in patent Document 1, the directivity is improved in such a way that the whole grounding electrode on the back surface in the length direction of a coupling line portion where the electromagnetic field of the waveguide is coupled to the microstrip line is made to retreat a fixed distance in the width direction of the coupling line portion. When a waveguide and microstrip line of fixed dimensions are used, it is understood that the directivity is improved up to 20 dB by making the grounding electrode on the back surface retreat a fixed distance in the width direction of the coupling line portion. Furthermore, in Patent Document 1, although the grounding electrode on the back surface is made to have a fixed shape for the purpose of improving the directivity at connection to the waveguide, also the same effect can be obtained in the structure where, instead of the waveguide, the center conductor of a coaxial line is made a main conductor.

Patent Document 1: Japanese Unexamined Patent Application Publication No. 2-26103

However, in the structure of Patent Document 1, since the grounding electrode on the back surface is made to retreat in the line width direction over the whole coupling line portion where the microstrip line and the waveguide are coupled, there is a problem in that the directivity greatly changes by a little positional displacement between the microstrip line and the grounding electrode when the electrode pattern is formed. The problem is described by using the structure in FIGS. 5A and 5B where the structure in Patent Document 1 is used for coupling to the coaxial line.

FIGS. 5A and 5B are schematic sectional views of a substrate surface where the line portion of a microstrip line coupled to a coaxial line is formed is cut as a sectional surface. In a directional coupler having the structure as in FIG. 5, in order to obtain the directivity of a current flowing in a microstrip line 40, the strength of a magnetic field coupling and the strength of an electric field coupling generated between the center conductor 42 (hereinafter, referred to as the main line) of a coaxial line 41 and the microstrip line 40 are required to be made equal to each other. FIG. 5A shows the direction of a current flowing in the microstrip line 40 when both lines are coupled by a magnetic field generated in the main line 42. A circular magnetic field 44 is generated around the main line 42 by a current flowing in the main line 42. A substrate 45 having the microstrip line 40 formed is inserted in the magnetic field and, when the microstrip line 40 is brought close to the main line 42, the main line 42 and the microstrip line 40 are coupled by the magnetic field 44. At this time, an induced current 46 is generated in a coupling line portion 47 of the microstrip line 40. The induced current 46 flows from one end of the microstrip line 40 to the other end.

On the other hand, FIG. 5B shows the direction of a current flowing in the microstrip line when the main line and the microstrip line are coupled by a capacitance generated between both lines. When the microstrip line 40 is brought close to the main line 42, a coupling capacitance 48 is generated between the main line 42 and the microstrip line 40 and an electric field coupling is caused between the lines. At this time, since a substantially symmetrical electric field strength distribution is obtained over from the middle point of the coupling line portion 47 to both ends 49 and 50 of the microstrip line 40, the currents 51 and 52 of the same magnitude are generated in the same direction at both ends 49 and 50 of the microstrip line 40.

When a directional coupler is constituted by close arrangement of a main line and a microstrip line, both a magnetic field coupling and an electric field coupling occurs, and currents corresponding to those flows in the microstrip line. In FIGS. 5A and 5B, when the amount of electric field coupling and the amount of magnetic field coupling are the same, since the amount of a current 46 flowing into the other end 50 of the microstrip line which is generated by the magnetic field coupling and a current 51 flowing into one end 49 of the microstrip line which is generated by the electric field coupling become substantially the same, the current to one end 49 does not flow and the current only to the other end 50 flows. Therefore, the directivity of a current flowing in the microstrip line is decided and the directivity of the directional coupler can be obtained. Then, when a monitor circuit is connected to the other end 50, it is able to monitor the electric power 43 passing through the main line 42.

In Patent Document 1, the electric field strength between the microstrip line and the grounding electrode is changed by making the grounding electrode opposite to the coupling line portion retreat a fixed amount in the line-width direction, and thus, the magnetic field coupling amount and the electric field coupling amount between the microstrip line and the main line are made equal to obtain the directivity. However, since the whole grounding electrode opposite to the coupling line portion is made to retreat, the amount of change of the magnetic field coupling amount and the electric field coupling amount generated between both lines which is caused by the amount of retreat of the grounding electrode becomes large. Therefore, when positional displacement between the grounding electrode and the microstrip line occurs in formation of the electrode pattern, etc., since either of the magnetic field coupling amount and the electric field coupling amount between both lines becomes larger, there occurs a problem in that the directivity cannot be obtained.

SUMMARY OF THE INVENTION

In order to solve the above-described problem, a directional coupler of the present invention comprises a grounding electrode contained on one main surface of a substrate; a line portion contained on the other main surface of the substrate and constituting a microstrip line together with the grounding electrode; and a main line disposed so as to be coupled at high frequencies to a coupling line portion being a part of the line portion and be substantially in parallel to the coupling line portion. In the directional coupler, a notch portion, in which a part of the grounding electrode opposite to the coupling line portion through the substrate is cut in the width direction of the coupling line portion from the edge portion of the substrate so as to include at least the coupling line portion, is contained.

In the structure of the present invention, since the notch portion in the width direction of the microstrip line is contained in a part of the grounding electrode opposite to the coupling line portion of the microstrip line so as to include at least the coupling line portion, the change of directivity due to positional displacement between the microstrip line and the coupling line portion can be reduced.

Furthermore, the present invention is characterized in that notch portions are contained at both ends in the length direction of the coupling line portion.

In the structure of the present invention, the notch portions of the grounding electrode are contained at both ends of the coupling line portion. The electric field strength generated between the line portion on the substrate top surface and the grounding electrode on the substrate back surface is higher in the middle portion in the length direction of the coupling line portion. When the grounding electrode in the middle portion of the coupling line portion is left, since the electric field coupling amount between the coupling line portion and the grounding electrode can be easily controlled, it is also easy to control the directivity.

Furthermore, the present invention is characterized in that the electric field strength generated between the coupling line portion and the grounding electrode is lower in the notch portions of the grounding electrode than in the grounding electrode having no notch portion.

In the structure of the present invention, since the notch portions are contained in a portion where the electric field coupling between the coupling line portion and the grounding electrode is high, the electric field coupling between the coupling line portion and the grounding electrode can be easily controlled and also it is easy to control the directivity.

Furthermore, the present invention can be also used in a circuit in which the main line is the center conductor of a coaxial line.

As in the present invention, in a directional coupler made up of a grounding electrode contained on one main surface of a substrate, a line portion contained on the other main surface of the substrate and constituting a microstrip line together with the grounding electrode, and a main line disposed so as to be coupled at high frequencies to a coupling line portion being a part of the line portion and be substantially in parallel to the coupling line portion, since a notch portion in the width direction of the coupling line portion from the edge portion of the substrate and including at least the coupling line portion which is opposite to the coupling line portion through the substrate is contained in a part of the grounding electrode, the directivity necessary for monitoring the transmission electric power can be obtained and the change of the directivity due to positional displacement between the line portion and the grounding electrode when the electrode pattern is formed can be reduced.

REFERENCE NUMERALS

Figure 1A:
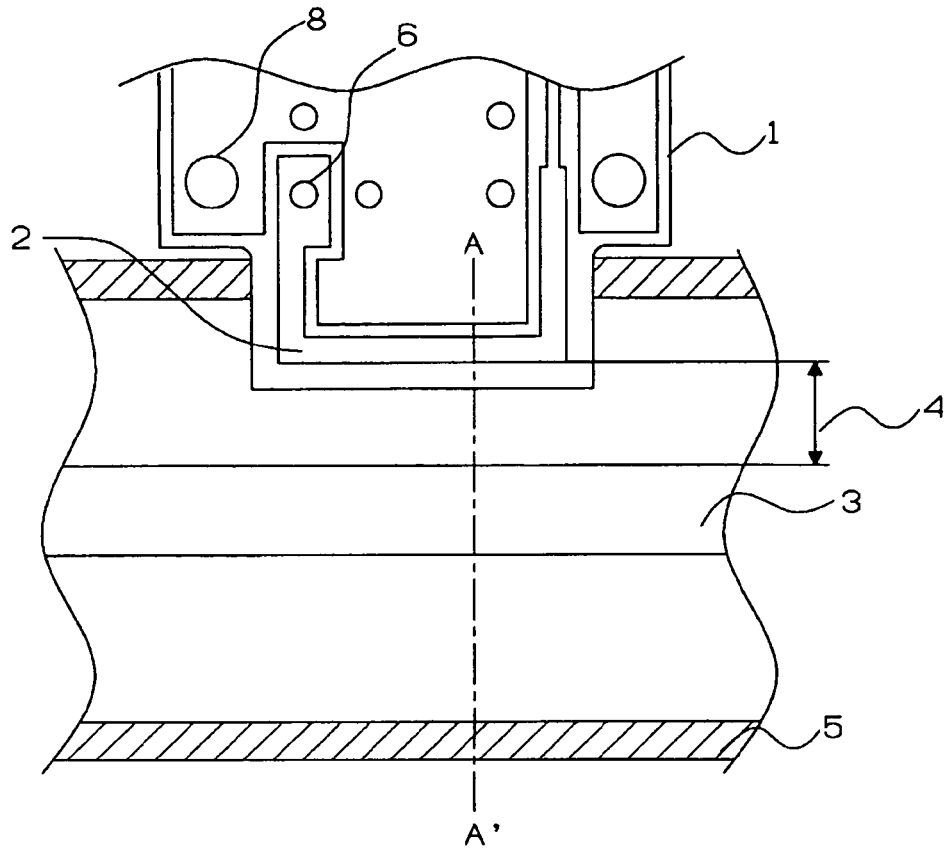
FIG. 1A is a schematic top view and FIG. 1B is a schematic sectional view of a directional coupler of a first embodiment.

1, 31, and 45 substrates
2, 30, and 40 line portions of a microstrip line
3, 32, and 42 main lines
4 coupling space
5 external conductor
6 through hole
7 and 33 grounding electrodes
12 terminating resistor
13, 20, 21, and 22 notch portions
44 coupling magnetic field
48 coupling capacitance
49 one end of a microstrip line
50 the other end of a microstrip line
51 current flowing to one end of a microstrip line
52 current flowing to the other end of a microstrip line

DESCRIPTION OF THE INVENTION

A first embodiment is described with reference to FIGS. 1A through 2B.

Figure 1B:
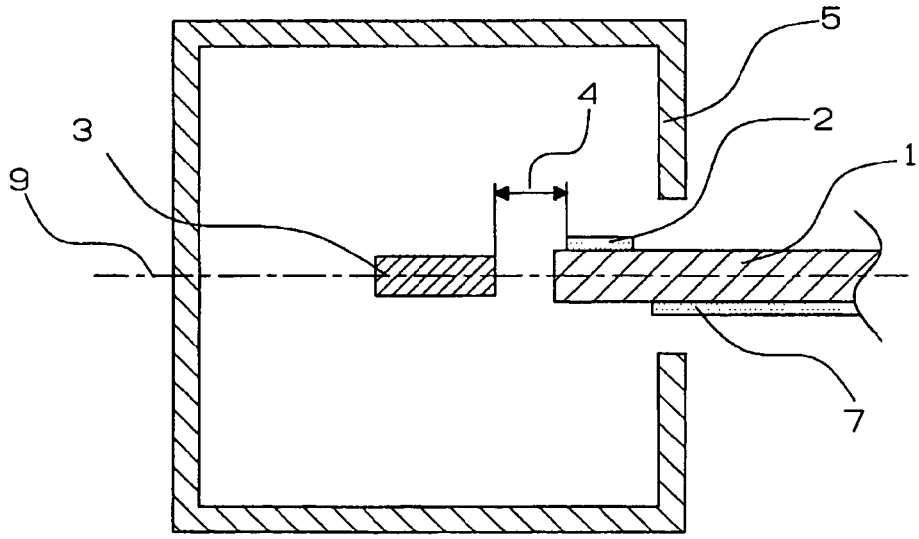

A directional coupler in which a microstrip line is disposed so as to be coupled at high frequencies to the main line of a coaxial line using copper as an external conductor is shown in FIG. 1A, and a schematic sectional view along line A-A' of FIG. 1A is shown in FIG. 1B. Moreover, the directional coupler shown in FIGS. 1A and 1B is used for the base station of 2 GHz-band portable telephones. In the present embodiment, a microstrip line 2 formed on a glass epoxy resin substrate 1 is disposed with a space 4 of 2 mm from a main line 3. Moreover, as shown in FIG. 1B, the glass epoxy resin substrate 1 on which the microstrip line 2 is formed is inserted inside the external conductor of a coaxial line through a notch portion formed in the external conductor 5 and disposed with the space 4 to the main line 3 being rectangular in section and having a width of 5 mm and a thickness of 0.5 mm. Moreover, the space between the center conductor and the external conductor of the coaxial line is a layer of air. At this time, the glass epoxy resin substrate 1 is disposed in such a way that the central axis in the thickness direction of the glass epoxy resin substrate 1 is substantially in agreement with the central axis 9 passing through the center in section of the coaxial line. Due to such a structure, the magnetic fields generated in a ring-shaped way around the microstrip line 2 and the main line 3 are coupled with each other and, as a result, both lines are magnetically coupled and simultaneously, because of the capacitance generated between the microstrip line 2 and the main line 3, the electric fields are coupled. Thus, the power of a high-frequency signal being propagated inside the coaxial line can be monitored. Moreover, as shown in FIGS. 1A and 1B, one end of the microstrip line 2 is connected to an electrode 7 on the back surface by a through hole 6, and the glass epoxy resin substrate 1 is mounted on a mounting substrate by a screw (not illustrated) to be inserted into a screw hole 8.

Figure 2A:
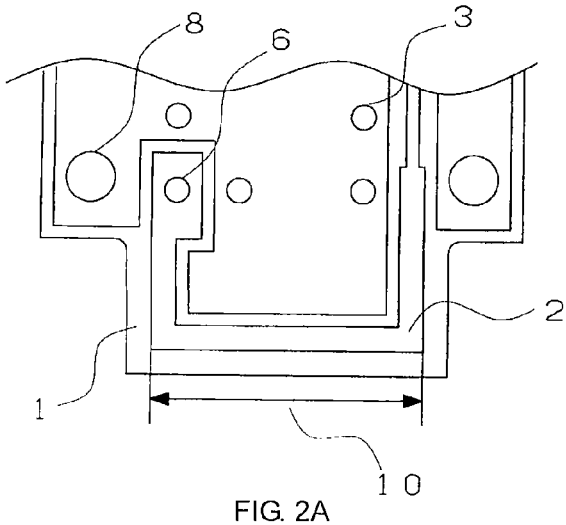
FIGS. 2A and 2B are schematic views of a microstrip line of a directional coupler of the first embodiment, FIG. 2A showing the top surface, and FIG. 2B showing the back surface.
Figure 2B:
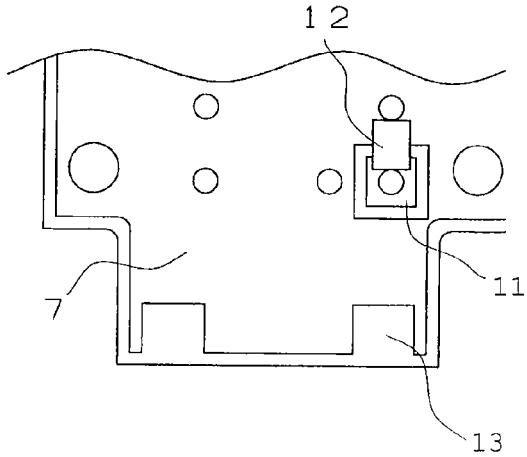

Next, the structure and manufacturing method of the portion of a microstrip line in the present embodiment are described. FIG. 2A shows the pattern of a substrate surface on which the microstrip line 2 is formed, and FIG. 2B is a schematic top view showing the pattern of the substrate back surface and the disposition of elements. First, a glass epoxy resin substrate 1 the thickness of which is 0.8 mm and on both surfaces of which a 16-μm thick copper electrode is formed is prepared. The electrode patterns as shown in FIGS. 2A and 2B are formed on both top and back surfaces of the glass epoxy resin substrate 1 by using a photolithography technology. At this time, in the microstrip line 2 to be coupled to the main line, the line width is made to be 0.8 mm so that the characteristic impedance may become 50Ω, and the line length is set to be half a wavelength in consideration of the effective dielectric constant on the glass epoxy resin substrate 1. Furthermore, the microstrip line 2 is formed so as to be U-shaped, and the length of a coupling line portion 10, which is disposed so as to be substantially parallel to the main line in order that the coupling line portion 10 may be coupled at high frequencies to the main line, is set to be 18 mm. Furthermore, on the back surface of the glass epoxy resin substrate 1, an electrode pad 11 for element-connection to which connection is made via a through hole 6 formed at one open end of the microstrip line 2 is formed. A terminating resistor 12 for terminating the open end of the microstrip line 2 with 50Ω is connected between the electrode pad 11 and the grounding electrode 7. Furthermore, the other open end of the microstrip line 2 is connected to a circuit in a high-frequency front-end portion (not illustrated).

In FIG. 2B, two rectangular notch portions 13 are located in the grounding electrode 7 opposite to both ends of the coupling line portion 10 on the substrate surface. In the notch portions 13, the grounding electrode 7 is removed so as to include the whole of the microstrip line 2 in the line width direction of the coupling line portion 10 from the end portion of the glass epoxy resin substrate 1. In the present embodiment, the length of the notch portion 13 is set to be 1 mm so that the directivity of the current flowing in the microstrip line 2 may be obtained. Moreover, the shape of the notch portions 13 can be changed in accordance with the substrate material to be used and its thickness.

Adjustment can be made so that the magnetic field coupling amount and electric field coupling amount may become equivalent between the coupling line portion 10 and the main line (not illustrated) and the directivity of the current flowing in the microstrip line 2 can be obtained by containing the notch portions 13 in the grounding electrode 7 opposite to the coupling line portion 10 as in the present embodiment. Furthermore, in the notch portions 13, since the grounding electrode 7 is removed so as to include the whole line of the coupling line portion 10, even if there is any positional displacement between the coupling line portion 10 and the grounding electrode 7 when the electrode pattern is formed, the change of the magnetic field and electric field strengths generated between the microstrip line 2 and the main line (the directivity) is small. A microstrip-line type directional coupler having the directivity can be reliably obtained by using such a structure of the present embodiment.

Furthermore, since the microstrip line 2 is a line in which a 50-Ω circuit is connected at both ends and the line length is half a wavelength, the vicinity of the middle of the coupling line portion has a strong electric field and easily accomplishes electric field coupling with the main line. Accordingly, the microstrip line 2 is made to be coupled through a magnetic field with the main line by leaving the grounding electrode 7 in the vicinity of the middle of the coupling line portion 10 as in FIGS. 2A and 2B and the electric field coupling amount and the magnetic field coupling amount are made equivalent to each other to obtain a desired directivity.

In a directional coupler for 2 GHz-band portable telephone devices as in the present embodiment, when the whole grounding electrode on the back surface of the substrate is retreated in the width direction of the coupling line portion, the directivity in the frequency band of 1.9 to 2.1 GHz has been as small as about 10 dB. However, when a structure as in the present embodiment is adopted, the directivity in the same frequency band is improved 10 dB to result in the directivity of 20 dB. As a result, a sufficient and stable directivity is obtained. Moreover, the coaxial line used in the present embodiment is rectangular in section, but another shape, circular, etc., in section, may be used.

Figure 3A:
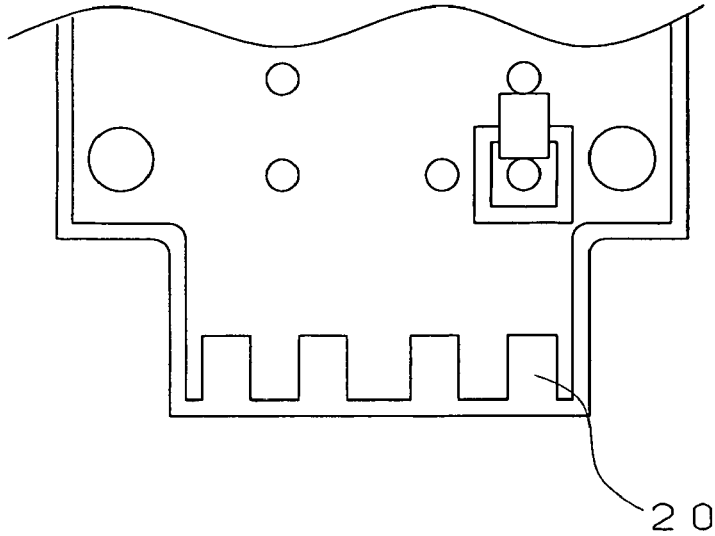
FIG. 3A is a schematic top view showing a grounding electrode of a directional coupler of a second embodiment.

A schematic top view of a grounding electrode of a second embodiment is shown in FIG. 3A. Although the notch portions have been shown at two locations in the grounding electrode in the first embodiment, three or more notch portions may be provided in accordance with the second embodiment. When a plurality of notch portions 20 are formed, the amount of change of the directivity due to the positional displacement between the coupling line portion and the pattern of the grounding electrode can be further reduced.

Figure 3B:
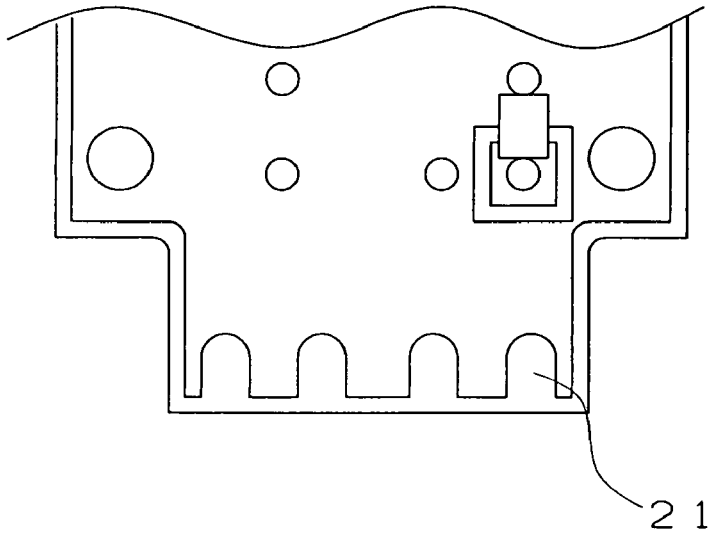
FIG. 3B is a schematic top view showing a grounding electrode of a directional coupler of a third embodiment.

A schematic top view of a grounding electrode in a third embodiment is shown in FIG. 3B. The third embodiment is a modified example of the second embodiment, and a part of each notch portion 21 is shaped in a circular arc. The effect of the third embodiment is the same as that of the second embodiment.

Figure 3C:
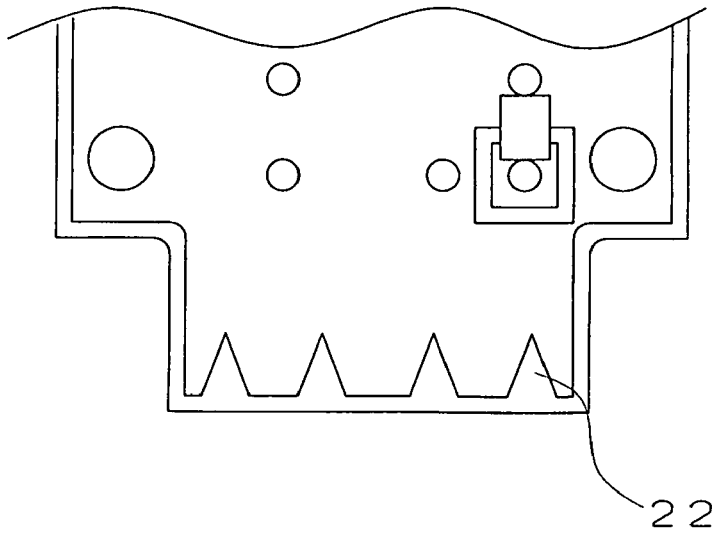
FIG. 3C is a schematic top view showing a grounding electrode of a directional coupler of a fourth embodiment.

A schematic top view of a grounding electrode in a fourth embodiment is shown in FIG. 3C. The fourth embodiment is a modified example of the second embodiment, and a part of each notch portion 22 is shaped in a triangular shape. The effect of the fourth embodiment is the same as that of the second embodiment.

Although what is different in the second to fourth embodiments is the shape of the notch portions, when the shape of the notch portions is proportionate to those in the embodiments, the same effect can be obtained. Furthermore, it is not required to unify the shape of the whole notch portions, and the notch portions which are partially different in shape from each other may be used.

Figure 4:
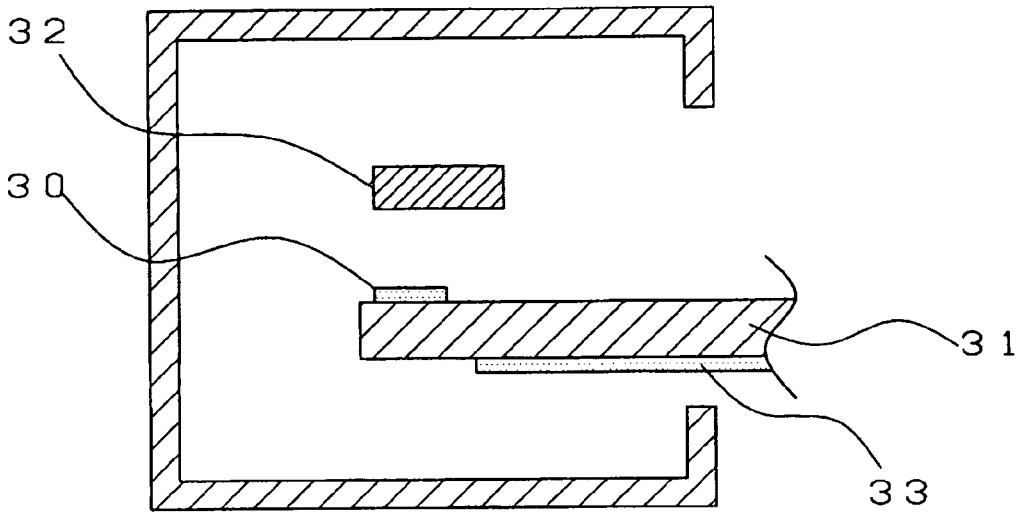
FIG. 4 is a schematic sectional view of a directional coupler of a fifth embodiment.
Figure 5A:
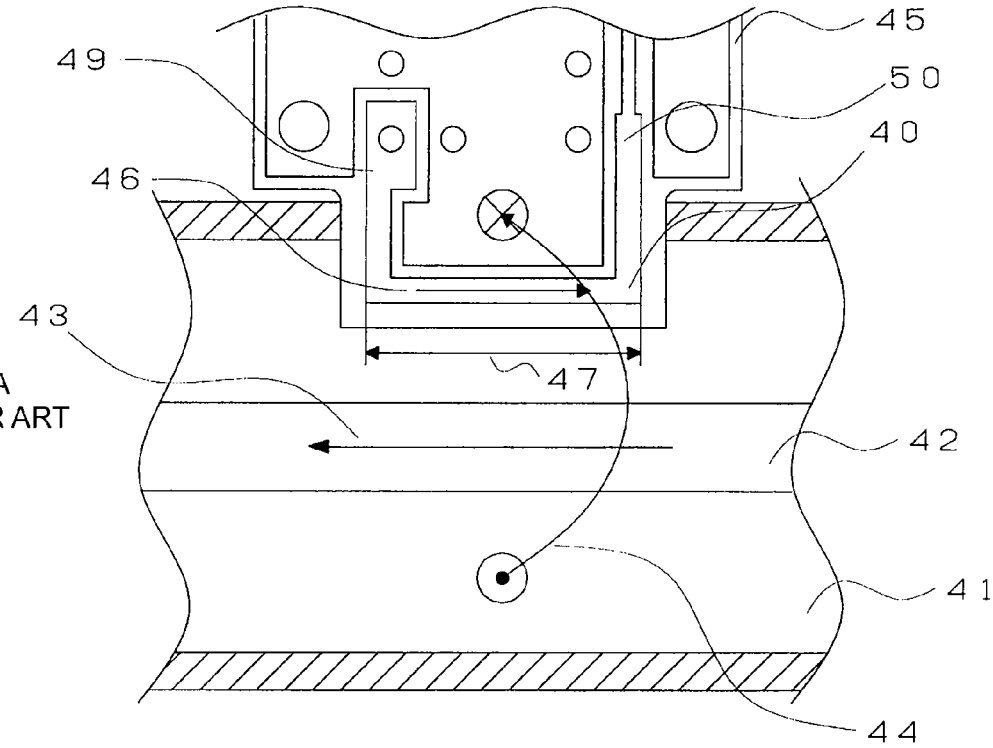
FIG. 5A PRIOR ART
FIGS. 5A and 5B are schematic top views showing the coupling state between a microstrip line and a main line of the prior art.
Figure 5B:
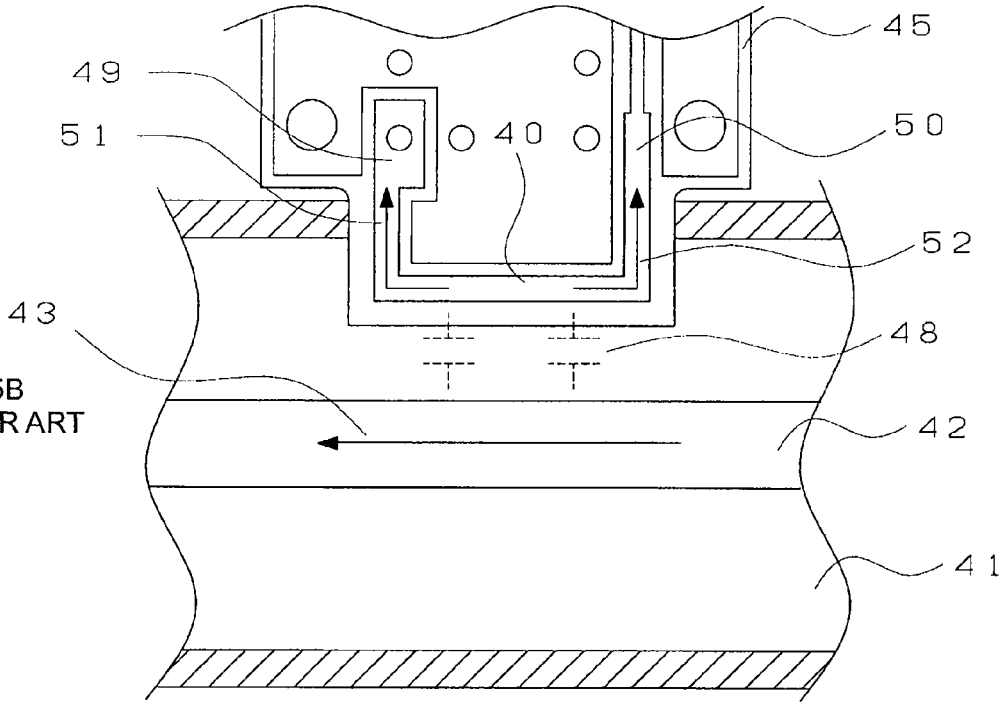
FIG. 5B PRIOR ART

Furthermore, a schematic sectional view showing a coupling method between a main line and a microstrip line in a fifth embodiment is shown in FIG. 4. In the structure of the present embodiment, a substrate 31 on which a microstrip line 30 is formed is disposed under the center conductor 32 of a coaxial line as the main line. When the circuit area, etc., are limited, the size of a circuit can be reduced without lowering the electrical characteristics in such a way that the substrate on which the microstrip line 30 is formed is inserted under the center conductor 32.

The invention claimed is:

1. A directional coupler comprising:

a grounding electrode formed on a first surface of a substrate;

a line formed on a second surface of the substrate and, together with the grounding electrode, forming a microstrip line having a coupling line portion; and a main line coupled to the coupling line portion, wherein the grounding electrode includes a notch portion opposite to the coupling line portion.

2. The directional coupler as claimed in claim 1, wherein the notch portion includes two notches located at opposite ends along a length direction of the coupling line portion.

3. The directional coupler as claimed in claim 1, wherein an electric field strength generated between the coupling line portion and the grounding electrode is lower in the notch portion of the grounding electrode than in a portion of the grounding electrode having no notch portion.

4. The directional coupler as claimed in claim 1, wherein the main line is the center conductor of a coaxial line.

5. The directional coupler as claimed in claim 1, wherein the main line is substantially parallel to the coupling line portion.

6. The directional coupler as claimed in claim 1, wherein the notch portion is formed in a width direction of the coupling line portion from an edge of the substrate.

7. A directional coupler comprising:

a substrate;

a grounding electrode formed on a first surface of the substrate; and a coupling line formed on a second surface of the substrate, wherein the grounding electrode includes a notch opposite to the coupling line.

8. The directional coupler as claimed in claim 7, wherein the notch is formed in a width direction of the coupling line from an edge of the substrate.

9. The directional coupler as claimed in claim 7, wherein the grounding electrode includes two notch at opposite ends along a length direction of the coupling line.

10. The directional coupler as claimed in claim 7, wherein an electric field strength generated between the coupling line and the grounding electrode is lower in the notch of the grounding electrode than in a portion of the grounding electrode having no notch.

* * * * *